US006062277A

United States Patent [19]

Seo

[11] Patent Number: 6,062,277

[45] Date of Patent: May 16, 2000

[54] DRIVING METHOD OF AUTOMATIC VENDING MACHINE

[75] Inventor: Eun-Goun Seo, Kwangju, Rep. of Korea

[73] Assignee: Kwangju Electronics Co., Ltd., Kwangju, Rep. of Korea

[21] Appl. No.: 09/151,730

[22] Filed: Sep. 11, 1998

[30] Foreign Application Priority Data

| | | | |
|---|---|---|---|
| Sep. 13, 1997 | [KR] | Rep. of Korea | 97-47475 |
| Sep. 13, 1997 | [KR] | Rep. of Korea | 97-47476 |
| Sep. 13, 1997 | [KR] | Rep. of Korea | 97-47477 |
| Aug. 14, 1998 | [KR] | Rep. of Korea | 98-33079 |

[51] Int. Cl.[7] ..... B65B 1/04

[52] U.S. Cl. ..... 141/362; 141/360; 141/94; 141/370; 222/129.4

[58] Field of Search ..... 141/94, 1, 351, 141/360–362, 82; 222/129.1, 129.3, 129.4, 146.1

[56] References Cited

U.S. PATENT DOCUMENTS

| | | | |
|---|---|---|---|
| 2,792,920 | 5/1957 | Sutphen et al. | 141/351 |
| 3,103,960 | 9/1963 | Simjian | 141/351 |
| 3,252,654 | 5/1966 | Deutch | 141/361 |
| 3,805,999 | 4/1974 | Syverson | 222/129.4 |
| 3,972,377 | 8/1976 | Esposito | 141/362 |
| 4,361,176 | 11/1982 | West | 141/362 |
| 4,679,715 | 7/1987 | Hovinga | 141/362 |
| 4,974,643 | 12/1990 | Bennett et al. | 141/1 |
| 5,141,130 | 8/1992 | Wiley et al. | 222/129.1 |
| 5,181,631 | 1/1993 | Credle, Jr. | 141/362 |
| 5,540,263 | 7/1996 | Hustvedt et al. | 141/360 |

*Primary Examiner*—J. Casimer Jacyna
*Attorney, Agent, or Firm*—Burns, Doane, Swecker & Mathis, L.L.P.

[57] ABSTRACT

A driving method of an automatic vending machine, the method comprising the steps of moving a cup holder member to an initial position, discriminating whether the cup holder member has been positioned in the initial position, stopping a product sales when the cup holder is not positioned in the initial position at the initial position discrimination step, converting the automatic vending machine to a stand-by state when the cup holder member is positioned in the initial position at the initial position discrimination step, and extracting raw materials and hot/cold water separately into the cup and selling the product, such that a cup supplied from a cup loading bin can be accurately accommodated in a cup holder member at a cup dispenser, thereby preventing an improper sale of product due to inaccurate positioning of the cup in the cup holder member or discontinuation of product due to the cup hitched at the cup dispenser, and improper sales of product can be prevented due to the cup holder member of the cup dispenser not being accurately moved to a raw material extraction position.

7 Claims, 8 Drawing Sheets

DRIVING METHOD OF AUTOMATIC VENDING MACHINE

This application claims priority under 35 U.S.C. §§119 and/or 365 to application Ser. No. 97-47475, filed in Korea, on Sep. 13, 1997; application Ser. No. 97-47476, filed in Korea, on Sep. 13, 1997; application Ser. No. 97-47477, filed in Korea, on Sep. 13, 1997; and application Ser. No. 98-33079, filed in Korea, on Aug. 14, 1998; the entire content of which is hereby incorporated by reference.

BACKGROUND OF THE INVENTION

1. Field of the Invention

The present invention relates to a driving method of an automatic vending machine, and more particularly to a driving method of an automatic vending machine adapted to separately supply raw materials from a raw material can and hot water or cold water from a hot/cold water can and to extract a stirrer for mixing the raw materials with the water, thereby enabling a sale of sanitary products.

2. Description of the Prior Art

Generally, an automatic vending machine is an unmanned selling method of products such as coffee, cigarettes, candies, books and the like, and a conventional coffee automatic vending machine is, as illustrated in FIG. 1, disposed with a body 1 for forming an exterior appearance thereof and a door 2 hinged to one front side of the body 1. The door 2 is arranged there outside with a door handle 3, a coin inserting slot 4, a product selection unit 5 equipped with a plurality of selection keys for selecting a desired kind of coffee, a cup housing slot 6 for extracting cups and a coin return slot 7 for returning changes.

Furthermore, an automatic vending machine according to the prior art includes therein, as illustrated in FIG. 2, a cup stacking bin 8, a raw material can 9, a raw material supplier 10, a raw material chute 11 installed underneath the raw material supplier 10, a hot water supplier 12, and a mixing unit 13 for mixing the raw material guided down from the raw material chute 11 with hot water supplied from the hot water supplier 12 and for extracting the cup disposed in the cup housing slot 6.

Now, a purchasing process of coffee utilizing a coffee automatic vending machine according to the prior art thus constructed with be described.

First of all, when a user selects a kind of coffee by inserting a coin and manipulating the product selection unit 5, a cup is accommodated into the cup housing slot 6. Raw materials such as coffee, cream, sugar and like are supplied to the mixing unit 13 via the raw material chute 11 and hot water is supplied thereinto. The mixing unit mixes the raw materials and hot water and supplies same into a cup accommodated in the cup housing slot 6 via a nozzle, and the user can purchase a desired coffee.

SUMMARY OF THE INVENTION

However, there is a problem in the conventional automatic vending machine thus described in that coffee remnants remain unwashed in a mixing unit to help bacteria such as colitis germs and the like to thrive therein, such that a user's health can be harmed due to propagation of the germs.

There is also a problem in the conventional automatic vending machine equipped with a stirrer for mixing raw materials with hot/cold water for sanitary sale of products in that a cup supplied from a cup stacking bin is not properly accommodated in a cup holder member of a cup dispenser, thereby making it difficult to properly sell the products.

There is another problem in that a cup accommodated in a cup holder member of a cup dispenser is not accurately moved to a raw material extraction position thereby making it difficult to properly sell the products.

The present invention is disclosed to solve the aforementioned problems and it is an object of the present invention to provide a driving method of an automatic vending machine equipped with a stirrer for mixing raw materials and hot/cold water separately supplied thereinto, the driving method adapted to accurately accommodate a cup supplied from a cup stacking bin into a cup holder member in a cup dispenser and to accurately move the cup holder member with the cup accommodated therein to a raw material extraction position as well.

In accordance with the objects of the present invention, there is provided a driving method of an automatic vending machine adapted to separately extract raw materials and hot/cold water into a cup according to manipulation of a user, the method comprising the steps of:

moving a cup holder member to an initial position;

discriminating whether the cup holder member has been positioned in the initial position;

stopping a product sales when the cup holder is not positioned in the initial position at the initial position discrimination step;

converting the automatic vending machine to a stand-by state when the cup holder member is positioned in the initial position at the initial position discrimination step; and extracting raw materials and hot/cold water separately into the cup and selling the product.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Now, preferred embodiment of the present invention will be described in detail with reference to the accompanying drawings.

Figure 1:
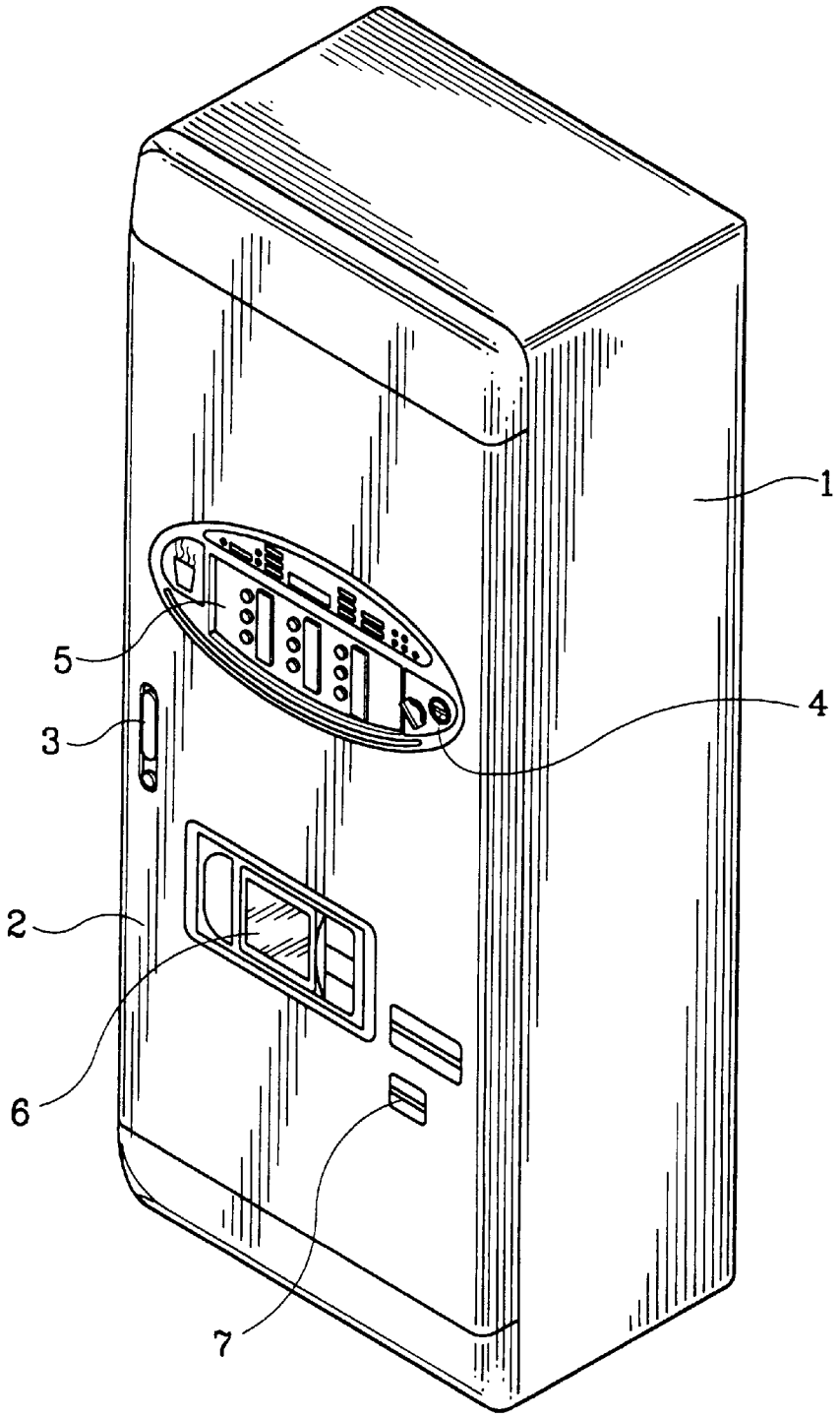
FIG.1(PRIOR ART)
FIG. 1 is an external view of an automatic vending machine according to the prior art.
Figure 2:
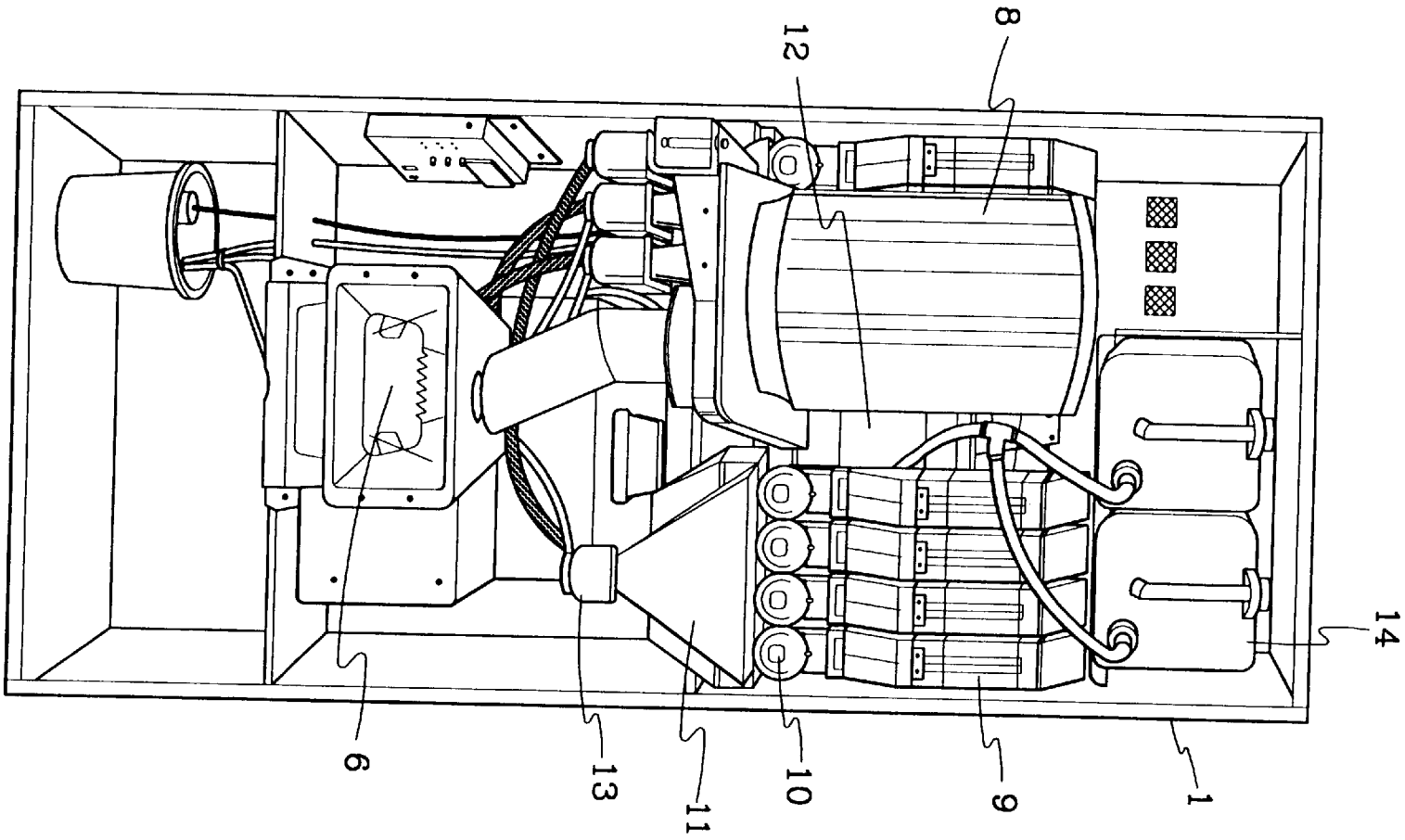
FIG.2(PRIOR ART)
FIG. 2 is an internal structure view of an automatic vending machine according to the prior art.
Figure 3:
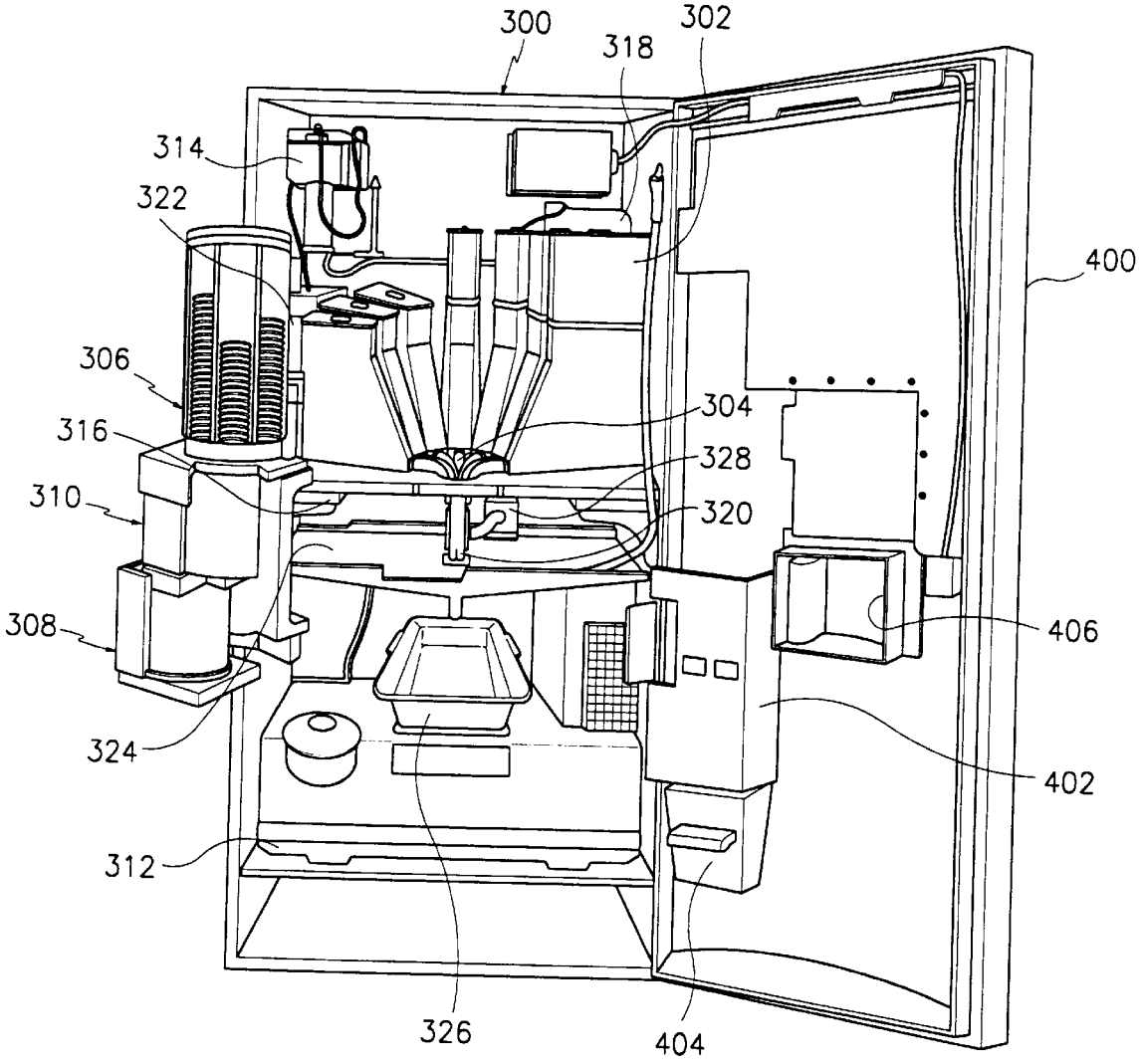
FIG. 3 is an internal structure view of an automatic vending machine according to the present invention.

FIG. 3 is an internal structure view of an automatic vending machine according to the present invention, where the machine includes a body 300 and a door 400 hinged to the body 300.

The body 300 is provided therein with a raw material can 302, a raw material extraction unit 304, a cup loading bin 306, a cup dispenser 310 for transferring a cup supplied from the cup loading bin 306 to the raw material extraction unit 304 to receive raw materials and to thereafter accommodate the cup in a cup housing 308, a water can 312, a purified water can 314 for purifying the water supplied from the water can 312 to thereafter store same, a hot water can 316, a cold water can 318, a hot/cold water nozzle 320 for extracting hot water or cold water stored in the hot water can 316 or cold water can 318, a stirrer box 322 for storing a plurality of stirrers and later extracting same during sale of products, a raw material pad 324 for containing raw material dregs, a drainage pad 326 for collecting the hot/cold water extracted from the hot/cold water nozzle 320 and a ventilator 328 for ventilating internal air and external air.

Meanwhile, the door 400 is arranged with a coin mechanism 402 for discriminating whether inserted coins are genuine or fake and ascertaining amount of the inserted coins, a coin accommodation can 404 for storing the inserted coins, and a product extraction hole 406 for extracting the cup in the cup housing 308.

Figure 4:
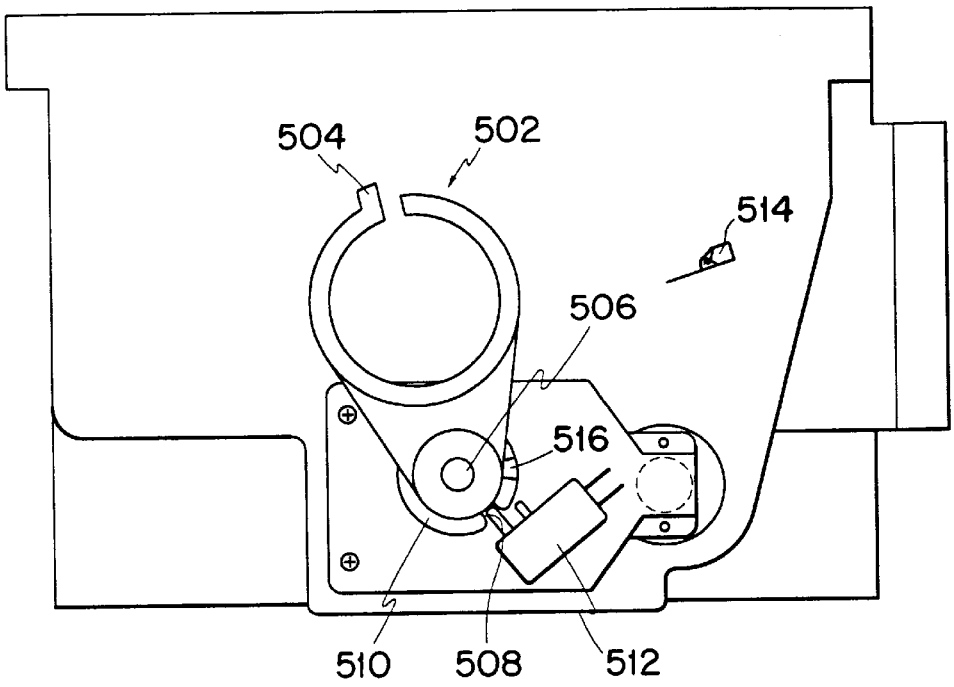
FIG. 4 is a schematic diagram for illustrating a status of an initial position to which a cup holder member is positioned from a cup dispenser illustrated in FIG. 3.
Figure 5:
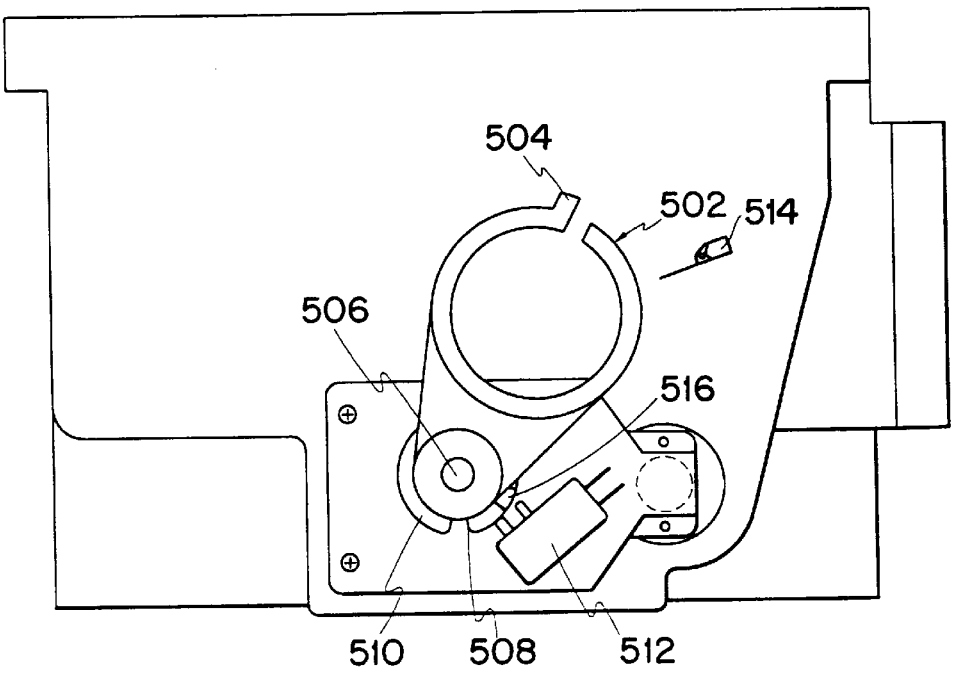
FIG. 5 is a schematic diagram for illustrating a status of a cup holder member not positioned from a cup dispenser illustrated in FIG. 3.
Figure 6:
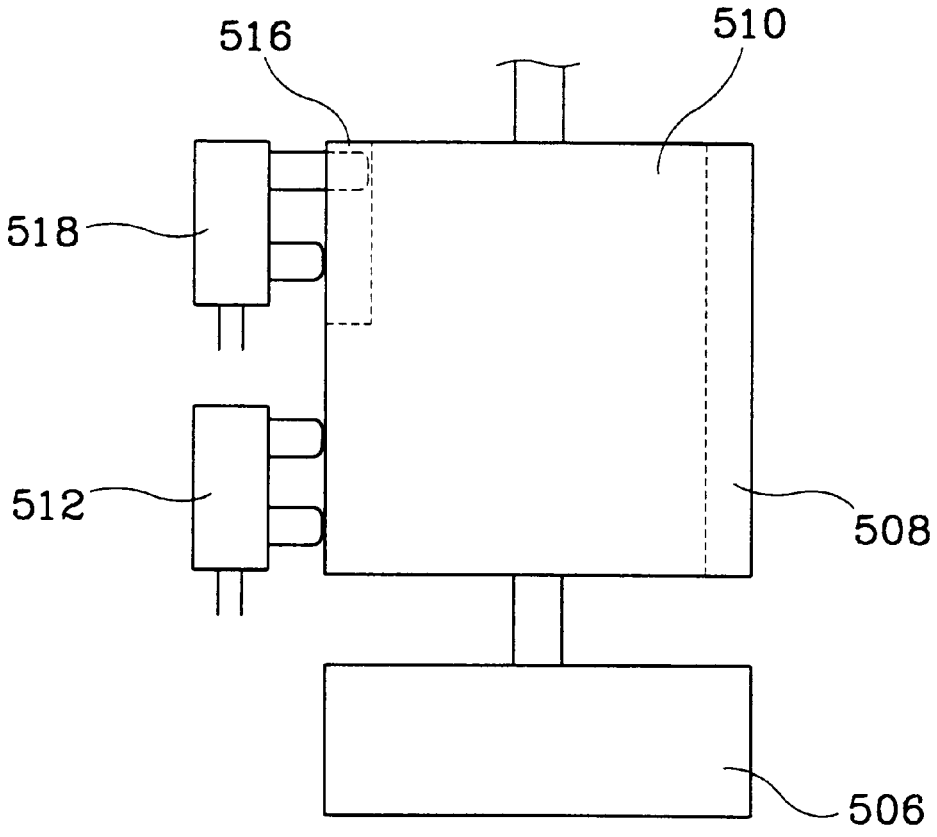
FIG. 6 is a schematic diagram for illustrating a cup holder member situated on a raw material extraction position from a cup dispenser illustrated in FIG. 3.

The cup dispenser 310 is mounted with, as illustrated in FIGS. 4, 5 and 6, a cup holder member 502, a cup guide motor 506, a rotary member 510 for being cooperatively rotated with a cup guide motor 506 and for being formed at both sides thereof with an initial position detecting groove 508 and a raw material extracted position detecting groove 516, an initial position detecting sensor 512 for detecting a position of the initial position detecting groove 508 formed at the rotary member 510, a raw material extracted position detecting sensor 518 for detecting a position of the raw material extracted position detecting groove 516 formed at the rotary member 510, and a hitching member 514 for causing a protruder 504 formed at the cup holder member 502 to be hitched during rotation of the cup holder member 502 to thereby extract the cup in the cup holder member 502 into the cup housing 308.

Figure 7:
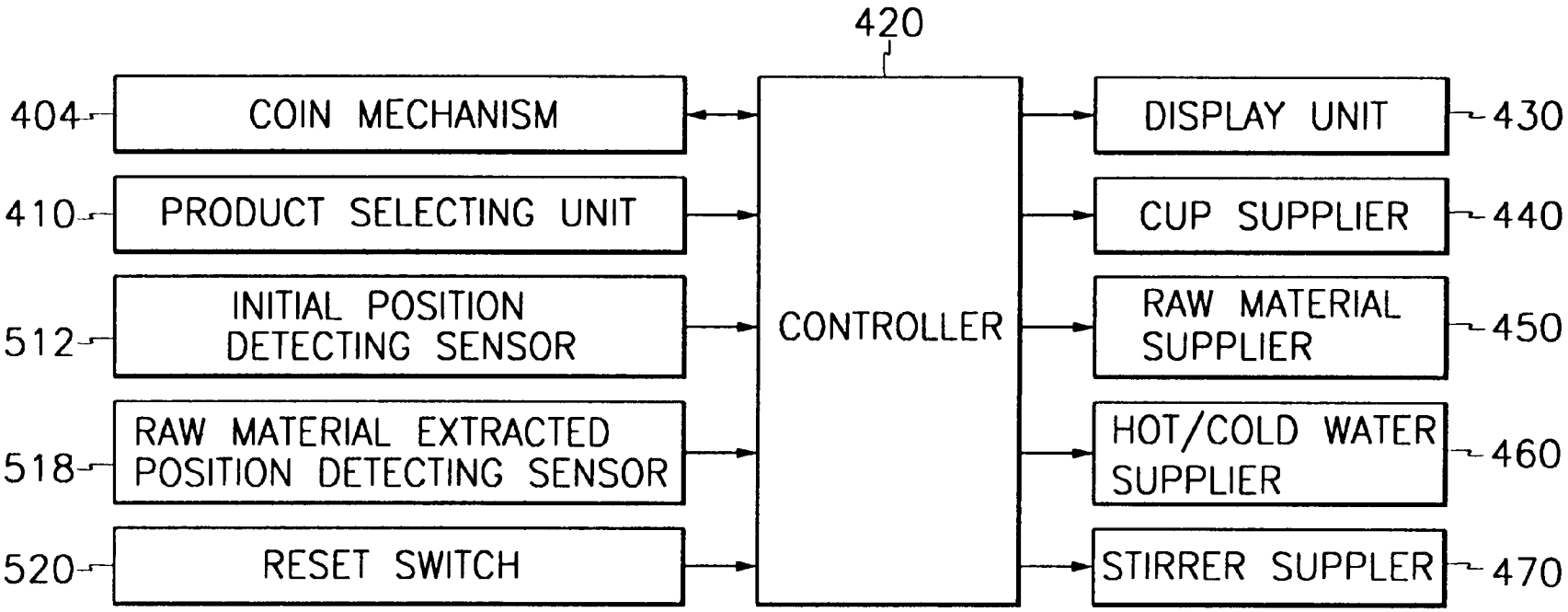
FIG. 7 is a schematic block diagram for illustrating an automatic vending machine for performing a driving method of an automatic vending machine according to the present invention.

FIG. 7 is a schematic block diagram for illustrating an automatic vending machine for performing a driving method according to the present invention, where the automatic vending machine includes a coin mechanism 404, a product selecting unit 410, a controller 420, a display unit 430, a cup supplier 440, a raw material supplier 450, a hot/cold water supplier 460, a stirrer supplier 470, an initial position detecting sensor 512, a raw material extracted position detecting sensor 518 and a reset switch 520.

The coin mechanism 404 serves to discriminate whether coins inserted from outside are genuine or fake and to ascertain amount of the coins to input same to the controller 420, and to return to a coin return hole (not shown) the changes after the product is sold according to control of the controller 420.

The product selecting unit 410 disposed with a plurality of buttons corresponding to respective products in the automatic vending machine serves to input a product selection signal to the controller 420 when the buttons are manipulated.

The initial position detecting sensor 512 detects the position of the initial position detecting groove 508 formed at the rotary member 510 cooperatively rotating with the cup guide motor 506 and input a detected signal corresponding thereto to the controller 420, as illustrated in FIGS. 4 and 5.

Furthermore, the raw material extracted position detecting sensor 518 detects the position of the raw material extracted position detecting groove formed at the rotary member 510 cooperatively rotating with the cup guide motor 506, as illustrated in FIG. 6, and inputs a detected signal corresponding thereto to the controller 420.

The reset switch 520 serves to input to the controller 420 a reset signal for moving the cup holder member 502 at the cup dispenser 310 to an initial position according to manipulation of an administrator. This is to prevent the cup holder member 502 at the cup dispenser 310 from being deviated from the initial position.

The controller 420 controls the display unit 430 so that it can display a product-saleable state when amount of the inserted money surpasses the price of the product, and also controls the cup supplier 440, the raw material supplier 450, the hot/cold water supplier 460 and the stirrer supplied 460 in order to sell products selected by the product selecting unit 410.

Furthermore, as illustrated in FIG. 5, when the initial position detecting groove 508 arranged on the rotary member 502 is deviated from the initial position detecting sensor 512 the cup holder member 502 is unable to be positioned on the initial position, such that a cup supplied from the cup loading bin 306 cannot be accurately accommodated into the cup holder member 502 at the cup dispenser 310.

Subsequently, the controller 420 drives the cup guide motor 506 when the initial position detecting groove 508 is deviated from the initial position detecting sensor 512, to thereby take the cup holder member 502 to the initial position. The cup supplied from the cup loading bin 306 is then accommodated into the cup holder member 502 accurately.

As illustrated in FIG. 6, when the raw material extracted position detecting groove 516 is deviated from the raw material extracted position detecting sensor 518, the cup in the cup holder member 502 is unable to be positioned on the raw material extracted position, such that raw material cannot be accurately put into the cup accommodated in the cup holder member 502.

Subsequently, the controller 420 drives the cup guide motor 506 when the raw material extracted position detecting groove 506 is off the raw material extracted detecting sensor 518 to put the cup holder member 502 on the raw material extracted position and to cause the raw material to be accurately inserted into the cup in the cup holder member 502.

Meanwhile, the cup supplier 440 accommodates the cup supplied from the cup loading bin 306 into the cup holder member 502 and moves the cup holder member 502 holding the cup toward the raw material extraction unit 304 to allow the raw material to be inserted thereinto. The cup filled with the raw material is then accommodated into the cup housing 308.

The raw material supplier 450 supplies raw material corresponding to a product selected via the product selecting unit 410 by a user according to control of the controller 420 to a cup moved by the cup holder member 502 at the cup dispenser 310 via the raw material extraction unit 304 from the raw material can 302.

The hot/cold water supplier 406 supplies hot water or cold water to a cup accommodated in the cup housing 308 via the hot/cold water nozzle 320. The stirrer supplier 470 drives an extraction motor according to control of the controller 420 to rotate stirrer extraction member (not shown) and extracts the stirrer in the stirrer box 322 to a cup in the cup housing 308.

Now, driving method of an automatic vending machine thus constructed according to the present invention will be described with reference to the accompanying drawings, FIGS. 3 to 9.

Figure 8:
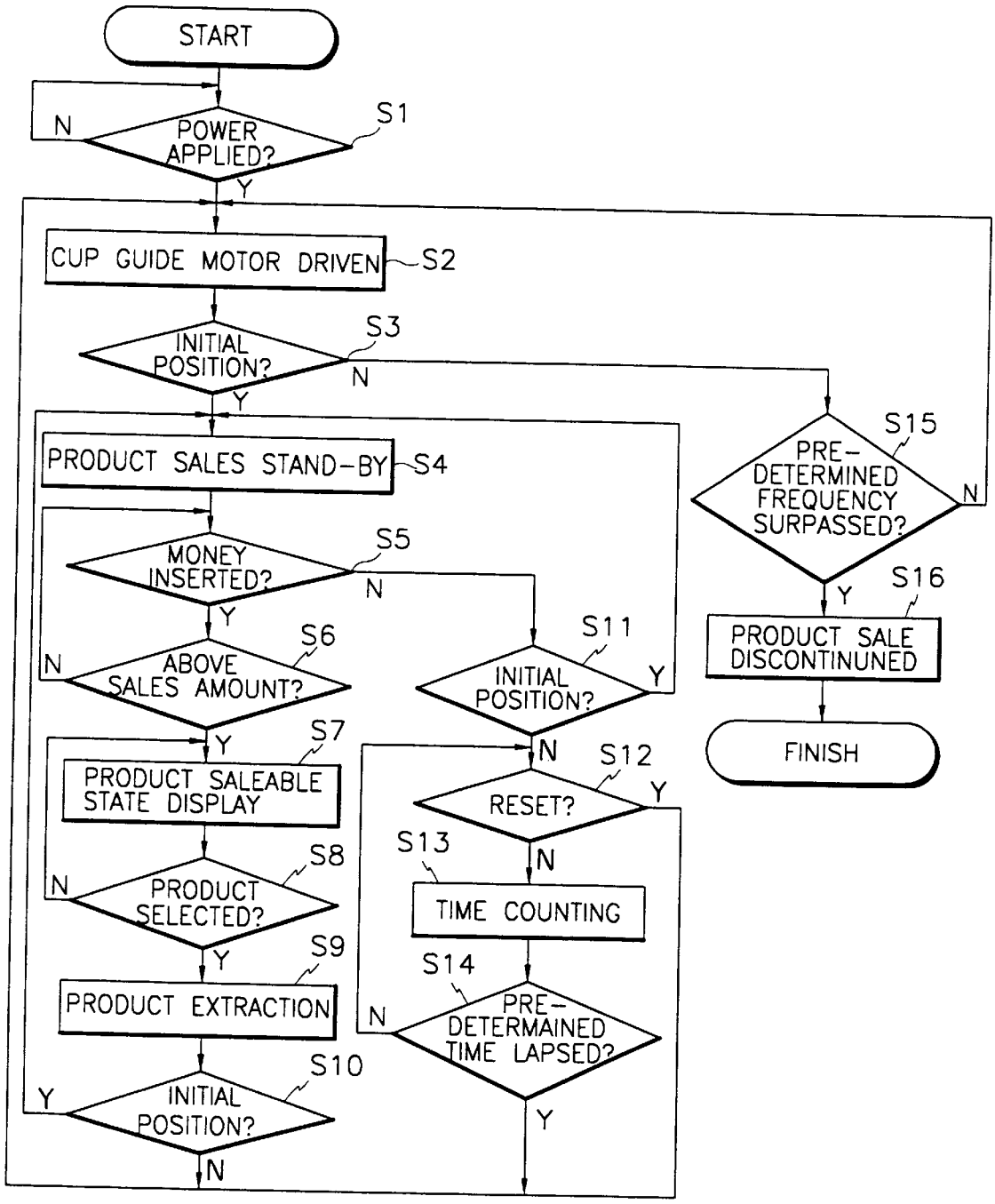
FIG. 8 is a flow chart of driving method of an automatic vending machine according to the present invention.
Figure 9:
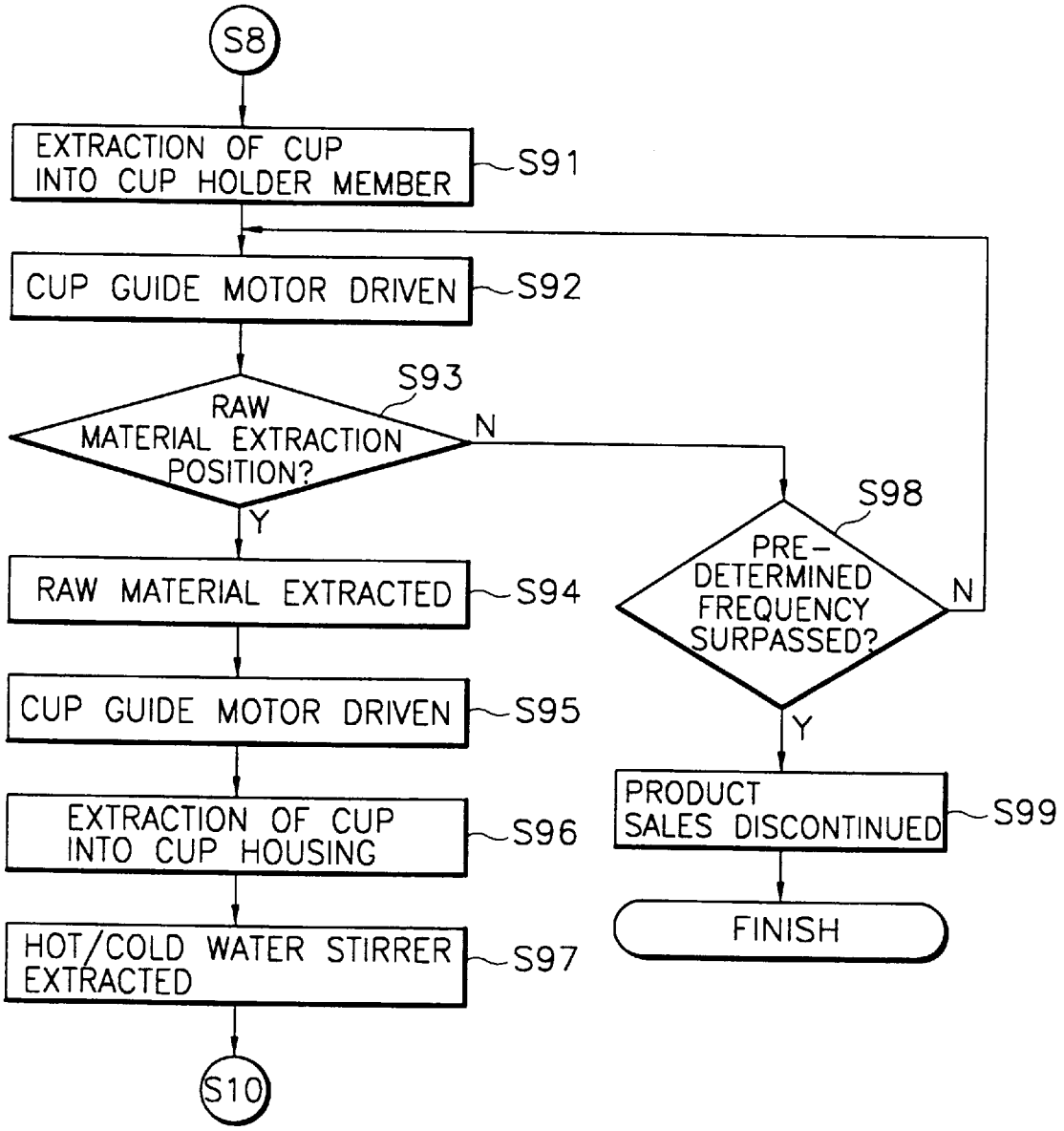
FIG. 9 is a sub-flow chart of step S9 in the driving method of an automatic vending machine according to the present invention illustrated in FIG. 8.

FIG. 8 is a flow chart for illustrating the driving method of the automatic vending machine according to the present invention and FIG. 9 is a sub-flow chart of step S9 in FIG. 8, where S denotes step.

As illustrated in FIG. 8, the controller 420 discriminates whether a commercial alternating current AC power has been supplied from outside, step S1, and when it is supplied, the controller performs step S2.

The controller 420 drives the cup guide motor 506 for a predetermined period of time and moves the cup holder member 502 to an initial position, step S2.

At this time, as the rotary member 50 is cooperatively rotated with the cup guide motor 506, the initial position detecting groove 508 formed at the rotary member 510 is also rotated.

Successively, position of the initial position detecting groove 508 formed at the rotary member 510 is detected by the initial position detecting sensor 512 and is input to the controller 420 step S3, where the controller 420 discriminates whether the cup holder member 502 is situated at the initial position according to control signal input by the initial position detecting sensor 512, and when the cup holder member 502 is put on the initial position, the controller executes step S4, and when the cup holder member 502 is not situated on the initial position, the controller 420 executes step S15.

The controller 420 converts the automatic vending machine to a product sales stand-by state, step S4, and performs step S5.

At step S5, the controller 420 discriminates whether money has been inserted by the user through money insertion hole, and when the money has been inserted, the controller executes step S6, and when the money has not been inserted, the controller performs step S11.

At step S6, the amount of money inserted via the coin mechanism is detected and input to the controller 420, which in turn compares the inserted amount of money with a sales price of product, and if the inserted amount of money is less than the sales price of the product, the controller 420 repeats step S5 and if the inserted amount of money is above the sales price of the product, the controller 420 executes step S7.

At step S7, the controller 420 controls the display unit 430 in order to display that product is under saleable state, which is displayed on the display unit 430.

Successively, at step S8, the controller 420 discriminates whether a desired product is selected by the user via the product selecting unit 410, and if the desired product is not selected, the controller 420 repeats the step S7 and if the desired product is selected, the controller 420 performs step S9.

At step S9, the controller 420 respectively controls the cup supplier 440, raw material supplier 450, hot/cold water supplier 460 and stirrer supplier 470 in order to extract the product selected by the product selecting unit 410, and extracts the product selected by the user.

Now, step S9 is described in more detail with reference to FIG. 9.

First of all, at step S91, the cup supplier 440 is activated by control of the controller 420, and a cup stacked at the cup leading bin 306 is supplied to the cup dispenser 310 by the drive of the cup supplier 440 and is accommodated into the cup holder member 502 situated at the initial position.

Successively, at step S92, the controller 420 drives the cup guide motor 506 at the cup dispenser 310 for a predetermined period of time to move the cup holder member 502 to a raw material extracted position. At this time, as the rotary member 510 is cooperatively rotated with the cup guide motor 506, the raw material extracted position detecting groove 516 formed at the rotary member 510 is also rotated.

At step S93, position of the raw material extracted position detecting groove 516 formed at the rotary member 510 is detected by the raw material extracted position detecting sensor 518 and is input to the controller 420, which in turn discriminates whether the cup holder member 502 is positioned on the raw material extracted position by a detected signal input by the raw material extracted position detecting sensor 518, and if the cup holder member 502 is situated on the raw material extracted position, the controller 420 executes step S94 and if the cup holder member 502 is not on the raw material extracted position, the controller 420 performs step S98.

At step S94, the raw material supplier 450 is driven by control of the controller 420, and raw material corresponding to a product selected from the raw materials stored in the raw material can 302 by the drive of the raw material supplier 450 is extracted into the cup accommodated in the cup holder member 502 via the raw material extraction unit 304.

Successively, at steps S95 and S96, the cup guide motor 506 is actuated by the control of the controller 420 to allow the cup filled with raw material to be moved again to the initial position. At this time, the protruder formed at a predetermined portion of the cup holder member 502 is hitched by hitching member 514, such that the cup in the cup holder member 502 is deviated from the cup holder member 502 to thereafter be accommodated into the cup housing 308.

At step S97, th hot/cold water supplier 460 is driven by control of the controller 420 and the hot water or cold water respectively stored in the hot water can 316 or in the cold water can 318 is supplied into the cup in the cup housing 308 via the hot/cold water nozzle 320.

The controller 420 serves now to extract the stirrer by controlling the stirrer supplier 479, and an extraction motor in the stirrer supplier 470 is driven to allow the stirrer to be extracted into the cup in the cup housing 308.

Meanwhile, after step S9 is executed as described above, step S10 is performed, where the position of the initial position detecting groove 508 formed at the rotary member 510 is detected by the initial position detecting sensor 512 and is input to the controller 420. The controller 420 discriminates whether the cup holder member 502 is situated on the initial position according to the detected signal input from the initial position detecting sensor 512, and if the cup holder member 502 is positioned on the initial position, the controller 420 performs step S4, and if the cup holder member 502 is not put on the initial position, the controller 420 executes step S2.

In other words, if the cup holder member 402 is not moved to the initial position due to slip of the cup guide motor 506 or the like, the controller 420 repeats performances at step S2 and positions the cup holder member 502 to the initial position accurately.

Meanwhile, when the money is not inserted at step S5, the controller performs step S11, where the position of the initial position detecting groove 508 formed at the rotary member 510 is detected by the initial position detecting sensor 512 and input to the controller 420. The controller 420 discriminates whether the cup holder member 502 is situated at the initial position according to the detected signal input from the initial position detecting sensor 512, and if the cup holder member 502 is positioned on the initial position, the controller 420 repeats step S4 and if the cup holder member 502 is not put on the initial position, the controller 420 executes step S12.

At step S12, a discrimination is made as to whether a reset signal is input to the controller 420 according to manipulation of reset switch by the administrator, and if the reset signal is input, the controller 420 repeats step S2, and it the reset signal is not input, the controller 420 performs step S13.

At step S13, the controller 420 uses a pre-arranged timer to count the time from which the cup holder member 502 is deviated from the initial position and executes step S14. At step S14, the controller 420 discriminates whether the time counted by the timer has passed a predetermined period of time, and if the time counted by the timer has not passed the predetermined period of time, the controller 420 repeats step S12 and if the time counted by the timer has passed the predetermined period of time, the controller 420 repeats step S2.

In other words, because at steps S11 to S14, the cup holder member 502 may be deviated from the initial position during cleaning operation of inner areas of the automatic vending machine, the administrator manipulates the reset switch 520 where the cup holder member 502 is deviated from the initial position to input a reset signal to the controller 420, thereby moving the cup holder member 502 to the initial position, and when the cleaning operation is finished, the cup holder member 502 can be automatically moved to the initial position even though the reset switch 520 is not manipulated by the administrator once a predetermined period of time (preferably 30 minutes) lapses where the cup holder member 502 is deviated from the initial position.

Meanwhile, at step S3, if the cup holder member 502 is not positioned on the initial position, the controller 420 executes step S15, where a discrimination is made as to whether repeated frequency for execution of step S2 (that is, the frequency for driving the cup guide motor 506 to try to move the cup holder member 502 to the initial position) has surpassed a predetermined frequency, and if the repeated frequency for execution of step S2 has not surpassed the predetermined frequency, the control repeats step S2.

If the repeated frequency for execution of step S2 has passed the predetermined frequency, the controller executes step S16, where the controller 420 stops sales of products at the automatic vending machine.

In other words, at steps S15 and S16, even though the controller 420 repeats moving the cup holder member 502 to the initial position as frequency as the predetermined frequency, product sales become discontinued as long as the cup holder member 502 is not situated on the initial position, thereby preventing a disadvantage to the user.

As apparent from the foregoing, there is an advantage in the driving method of an automatic vending machine adapted to separately supply hot water or cold water from hot/cold water can and raw materials from a raw material can during product sales, and to extract a stirrer for mixing the raw materials and water, in that a cup supplied from a cup loading bin can be accurately accommodated in a cup holder member at a cup dispenser, thereby preventing an improper sale of product due to inaccurate positioning of the cup in the cup holder member or discontinuation of product due to the cup hitched at the cup dispenser.

There is another advantage in that improper sales of product can be prevented due to the cup holder member of the cup dispenser not being accurately moved to a raw material extraction position.

What is claimed is:

1. A driving method of an automatic vending machine adapted to separately extract raw materials and hot/cold water into a cup according to manipulation of a user, the method comprising the steps of:

moving a cup holder member to an initial position;

discriminating whether the cup holder member has been positioned in the initial position;

stopping a product sales when the cup holder is not positioned in the initial position at the initial position discrimination step;

converting the automatic vending machine to a stand-by state when the cup holder member is positioned in the initial position at the initial position discrimination step; and extracting raw materials and hot/cold water separately into the cup and selling the product;

wherein the initial position detecting step comprises the step of discriminating that the cup holder member has been positioned in the initial position when an initial position detecting groove formed at a rotary member cooperatively rotating with a cup guide motor for rotating the cup holder member is detected by an initial position detecting sensor.

2. The method as defined in claim 1, further comprising the step of executing the initialization when an electric power is input from outside.

3. The method as defined in claim 1, further comprising the step of performing to initialization again when a predetermined period of time lapses where the cup holder member is deviated from the initial position by discriminating whether the cup holder member is positioned on the initial position during executing of product sale stand-by step.

4. The method as defined in claim 3, wherein the initialization re-execution discrimination step comprises the step of executing the initialization when a reset signal is input from a reset switch.

5. The method as defined in claim 1, further comprising the step of executing the product sales stand-by when the cup holder member is positioned on the initial position after the step of product sales is completed and of execution the intialization when the cup holder member is not positioned on the initial position.

6. The method as difined in claim 1 or claim 5, wherein the product sales step comprises the steps of:

extraction a cup into the cup holder member;

moving the cup holder member with a cup to a raw material extraction position;

discriminating whether the cup holder member is positioned on a raw material extraction position;

discriminating sales of the product when the cup holder member in not positioned on the raw material extraction position at the raw material extracted position discrimination step;

extracting raw material selected by a user when the cup holder member is positioned on the raw material extraction position at the raw material extracted position discrimination step; and moving the cup holder member to the initial position to extract a cup filled with raw materials into a cup housing and extrating hot/cold water into the cup housed in the cup housing.

7. The method as difined in claim 6, wherein the raw material extracted position discrimination step comprises the step of discriminating that the cup holder member is positioned on the raw material extraction position when the raw material extracted position detecting groove formed at the rotary member cooperatively rotating with the cup guide motor for rotating the cup holder member is detected by the raw material extracted position detecting sensors.

* * * * *